US005832799A

United States Patent [19]

Lüthi et al.

[11] Patent Number: 5,832,799

[45] Date of Patent: Nov. 10, 1998

[54] DEVICE FOR TRIMMING EDGES FROM PRINTED DOCUMENTS

[75] Inventors: Ernst Lüthi, Brittnau; Kurt Heutschi, Wikon, both of Switzerland

[73] Assignee: Grapha-Holding AG, Herqiswil, Switzerland

[21] Appl. No.: 925,314

[22] Filed: Sep. 8, 1997

Related U.S. Application Data

[63] Continuation of Ser. No. 404,088, Mar. 14, 1995, abandoned.

[30] Foreign Application Priority Data

Mar. 16, 1994 [CH] Switzerland ..... 00 768/94

[51] Int. Cl.[6] ..... B26D 1/00

[52] U.S. Cl. ..... 83/423; 83/404.4; 83/409.1; 83/934

[58] Field of Search ..... 83/934, 403, 19, 83/423, 154, 131, 404.1, 404.3, 404.4, 409, 409.1, 673, 674, 346

[56] References Cited

U.S. PATENT DOCUMENTS

| | | | |
|---|---|---|---|
| 3,951,399 | 4/1976 | Reist | 270/58 |
| 4,038,893 | 8/1977 | Reist | 83/154 |
| 4,201,286 | 5/1980 | Meier | 198/461 |
| 5,113,731 | 5/1992 | Reist | 83/404.2 |
| 5,125,304 | 6/1992 | Petersen | 83/404 |

FOREIGN PATENT DOCUMENTS

| | | |
|---|---|---|
| 0 367 715 | 5/1990 | European Pat. Off. . |
| 418529 | 3/1991 | European Pat. Off. . |
| A-0 418529 | 3/1991 | European Pat. Off. . |
| 602593 | 6/1994 | European Pat. Off. . |
| A-0 602593 | 6/1994 | European Pat. Off. . |
| 673729 | 9/1995 | European Pat. Off. . |
| 2306800 | 11/1976 | France . |
| 308330 | 10/1918 | Germany . |
| 1253034 | 10/1967 | Germany . |
| 1778882 | 9/1971 | Germany . |
| 668216 | 12/1988 | Switzerland . |

*Primary Examiner*—Maurina T. Rachuba
*Attorney, Agent, or Firm*—Spencer & Frank

[57] ABSTRACT

A device is provided for trimming an edge of printed products which are fed continuously at regular distances to a conveying arrangement. The conveying arrangement includes circulating, pocket-like conveying units that are loaded from above with printed products. The edges of the printed products project at the conveying units so that the edges extend through a cutting arrangement laterally disposed at the conveying arrangement and including a blade. A support arrangement includes a shoulder disposed on a rear side of the printed product relative to the blade. The support arrangement is set back from the projecting edge of the printed product and is disposed opposite the blade during the cutting process. The support arrangement is movable into position at least approximately over a length of a cut by the blade and is driven in the same direction and at the same cadence as the printed products that are fed to the cutting arrangement.

12 Claims, 4 Drawing Sheets

Fig. 3
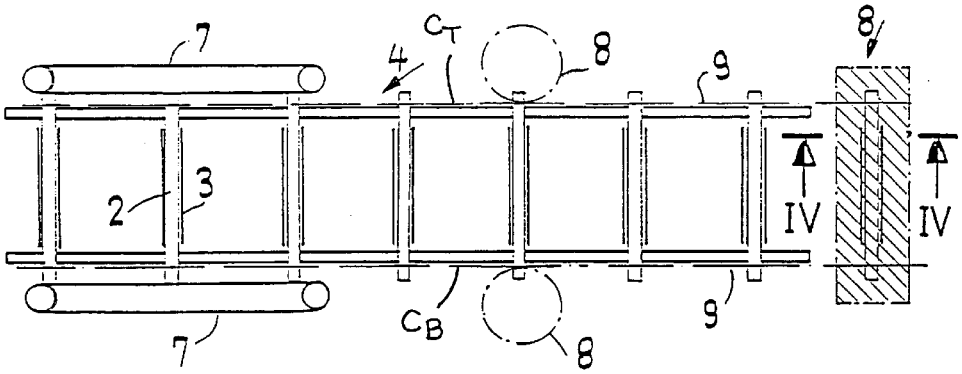
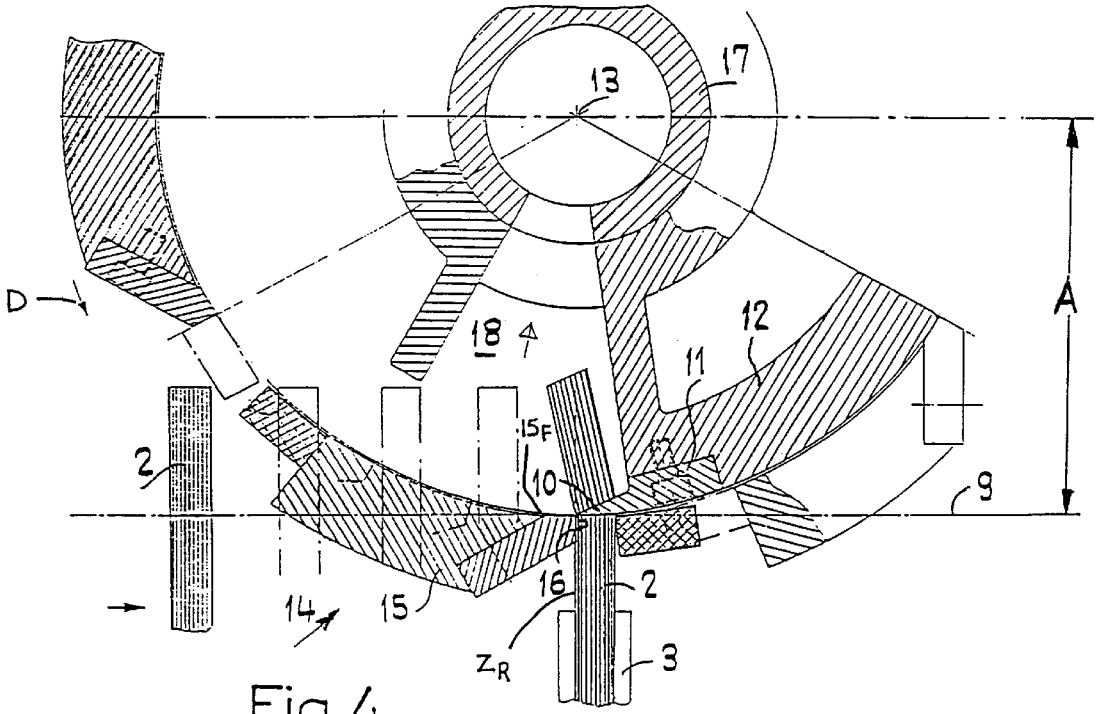
Fig.4

DEVICE FOR TRIMMING EDGES FROM PRINTED DOCUMENTS

This application is a continuation of application Ser. No. 08/404,088, filed Mar. 14, 1995 now abandoned.

BACKGROUND OF THE INVENTION

The invention relates to a device for trimming an edge of printed products which are fed continuously at regular distances to a conveying arrangement comprising circulating, pocket-like conveying units that are loaded from above, with the edges of the printed products projecting at the conveying units and extending through a cutting arrangement that is laterally disposed at the conveying arrangement.

Such a device is disclosed in Swiss application CH-A-668 216, wherein blades that are allocated in pairs are provided as a cutting arrangement. These blades are jointly attached at the same distances as the pocket-like conveying units of the conveying arrangement to continuously circulating, driven pulling elements, whose one run extends parallel to a section of the conveying arrangement comprised of pulling elements, and is driven in the same direction and at the same speed as the conveying arrangement.

This means in practice that the edges of the printed products projecting from the pocket-like conveying units for trimming are guided between the blade pairs of an opened cutting arrangement, are subsequently oriented toward the joint section formed by the adjacent parallel runs of the pulling elements of the cutting arrangement and the conveying arrangement, and are fixed and subsequently trimmed.

In the known embodiment there results a considerable distance on the joint section between the conveying units and the blade pairs of the cutting arrangement or the cutting edge. Because of this distance, the required cutting quality, particularly for relatively thin printed products, cannot be ensured.

Due to the required guide clearance at the proposed, chain-guided cutting arrangement and the conveying arrangement as well as between these arrangements, thicker printed products for which a greater cutting force is necessary are subject to an unreliable cutting precision. In contrast, a precise adjustment of the cutting position along the joint section of conveying arrangement and cutting arrangement is not necessary.

European application EP-A-0 367 715 discloses a method of trimming the lateral edges of continuously conveyed printed products in a run-through process, wherein each printed product is allocated a trailing, conveying-effective first blade section which moves or drives the printed product at essentially the same speed and moves the printed products into position with respect to one another along a designated cutting edge such that the first blade section, which corresponds to the conveying unit of a conveying arrangement, and the printed product associated with the first blade section can be guided along a second stationary blade section so as to be brought into cutting contact with the latter. For this purpose, an arrangement is proposed that is provided with a conveying arrangement having a plurality of conveying units circulating on a closed path for picking up the continuously arriving printed products. The conveying units on the rear side of the printed products contain an opposing blade and means for moving the printed products into position with the opposing blade in the conveying units, at least along the designated cutting edge, before the printed products pass through a stationary cutting blade (second blade section) which cooperates with the opposing blade (first blade section) of each conveying unit so that the printed products are trimmed along the formed cutting edge.

Because of the abruptly acting cutting forces, the construction of such an embodiment is very complex, if the stability with the conveying units that imparts the necessary cutting quality is to be achieved. It thus turns out to be unfavorable for the cutting process if the conveying units that are suspended on pulling elements and moved in longitudinal guides with lateral clearance are subjected to high stress.

SUMMARY OF THE INVENTION

It is an object of the invention to produce a device of the type mentioned in the beginning for the trimming of printed products, in which, based on a design that is different from the known constructions, the disadvantages that were mentioned do not occur or in which the required quality of the cut and the inherent stability necessary for this quality can be achieved in a simple manner.

The above and other objects are accomplished in the context of a device for trimming an edge of printed products which are fed continuously at regular distances to a conveying arrangement comprising circulating, pocket-like conveying units that are loaded from above with the printed products, the edges of the printed products projecting at the conveying units so that the edges extend through a cutting arrangement laterally disposed at the conveying arrangement and comprising a blade, wherein according to the invention there is additionally provided: a support arrangement including a shoulder disposed on a rear side of the printed product relative to the blade, the support arrangement being set back from the projecting edge of the printed product and disposed opposite the blade during the cutting process, the support arrangement being movable into position at least approximately over a length of a cut by the blade and being driven in the same direction and at the same cadence as the printed products that are fed to the cutting arrangement.

With this embodiment it is possible to keep the forces occurring due to the cutting process away from the conveying arrangement and to carry out the cutting process in a stable environment.

Advantageously, the support arrangement is configured to rotate around an axis that is arranged parallel to the cutting edge and the support arrangement is provided at its circumference with a plurality of shoulders that are distributed at the same distance as the conveying units of the conveying arrangement so that the cutting forces cannot be transferred to the conveying arrangement.

The descriptive part that follows discusses the device according to the invention on the basis of an embodiment that is shown in the figures.

BRIEF DESCRIPTION OF THE DRAWINGS

FIG. 3 is a partial view of an enlarged horizontal projection of the illustration in FIG. 1, FIG. 4 is a partial view of a section along the line IV—IV in FIG. 3.

DETAILED DESCRIPTION OF THE PREFERRED EMBODIMENTS

Figure 1:
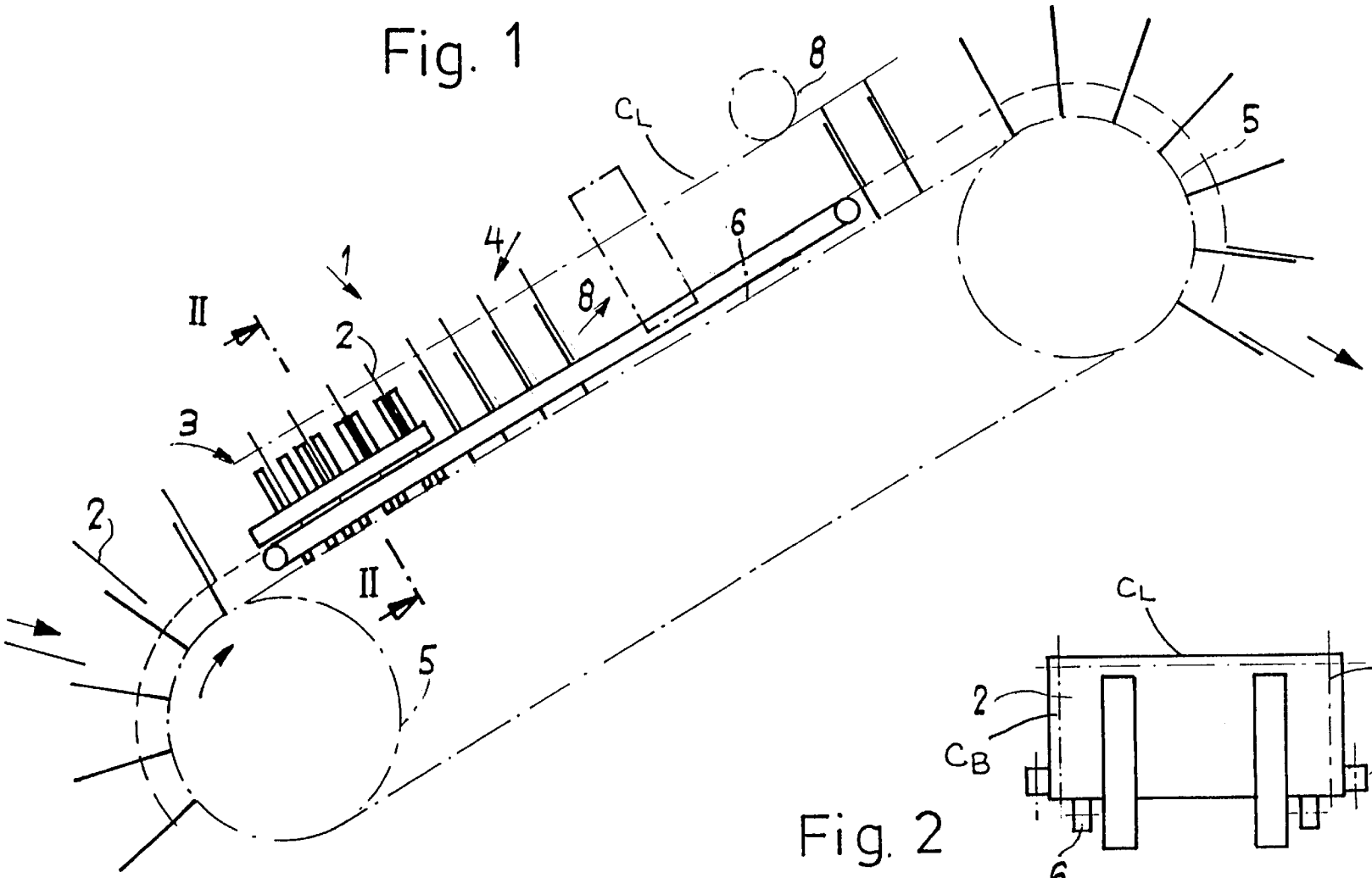
FIG. 1 is a schematic illustration of a side view of an arrangement of the device according to the invention.

FIG. 1 shows a device 1 for trimming a plurality of edges of printed products 2 that are fed at regular distances, for example, from a rotary printing press or a gather-stitcher. The printed products are loaded for conveyance in pocket-like conveying units 3 of a conveying arrangement 4, where the conveying units 3 are loaded from above. Each of the conveying units thus constitute a cell or compartment having an open top end for receiving the printed product. Conveying units 3 are configured with driven pulling elements in the form of continuously driven belts 6 that circulate continuously around at least two rollers 5 that are spaced apart. With respect to their capacity, conveying units 3 may be configured adjustably or such that they can be adjusted to the size of the loaded items or of the printed products 2 that are clamped into the conveying units during the cutting process. The path of the run of the conveying arrangement 4 is provided in an upwardly inclined manner so that printed products 2 positioned in the conveying units 3 can rest flatly stretched against the back wall of the conveying units. Retaining elements that are not shown ensure that printed products 2, after being placed into position for the trimming of edges, for example, with the aid of guiding means, are held at the rear wall of the conveying units 3.

Figure 2:
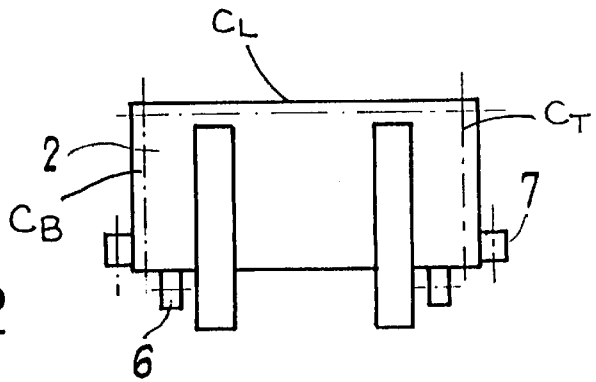
FIG. 2 is a cross section along line II—II in FIG. 1.

With respect to the positioning of printed products 2, two continuously driven belts 6 are provided below the conveying units 3, with the belts being arranged at a lateral distance from each other and providing a support surface for printed products 2 and preferably co-circulating at the same speed. Belts 6 can also be seen in FIG. 2. The lateral guidance of printed products 2 takes place in a similar manner by way of preferably adjustable guide belts 7 that are disposed laterally with respect to conveying arrangement 4 (see also FIG. 3). For this purpose, static deflection elements or other known means could also be used. The path of conveying arrangement 4, which is upwardly inclined to favor a flat resting of the fed printed products 2 in the conveying units 3, is, of course, not imperative. The conveying arrangement could also be disposed horizontally. The dash-dotted lines set back from the edges of printed products 2 in FIGS. 1 through 3 indicate the cutting edges of the printed products 2, with FIG. 1 indicating the cutting edge $C_L$ for the open lateral edge of the printed products 2, FIG. 2 noting the top cutting edge $C_T$, bottom cutting edge $C_B$ and lateral cutting edge $C_L$ and FIG. 3 again the top edge $C_T$ and bottom edge $C_B$.

FIG. 4 illustrates a cutting arrangement 8 associated with device 1, as is shown, for example, according to the configuration in FIGS. 1 and 3. Reference numeral 9 indicates the plane of the cutting edges of a printed product 2 for either the top cutting edge $C_T$, botton cutting edge $C_B$, or the lateral cutting edge $C_L$ that is to be cut. Along the plane 9 of the cutting edge is disposed an edge 10 of a stationary blade 11 projecting beyond the maximum width of the pages of a printed product 2, with the blade being oriented in a direction opposite to the conveying direction D of the printed products 2 and being detachably fastened to a support 12.

The blade edge 10 can be configured so that it deviates from the perpendicular with respect to the direction of conveyance and extends at an oblique angle over the length of the cut so that the cut is carried out during a short time. During a cutting operation, support 12 with its blade 11 is stationary. Support 12 is arranged so that it can rotate around an axis 13 (for a quick blade replacement as described below). Axis 13 is perpendicular with respect to the direction of conveyance and parallel to the cutting edge plane, with the distance of the axis perpendicular to the direction of conveyance having a changeable configuration. Edge 10 of the blade 11 can also be adjusted parallel to the direction of conveyance.

A driven support arrangement 14, is allocated to conveying arrangement 4, or to each conveying unit 3. The support arrangement 14 supportingly rests against the rear side $2_R$ of printed products 2 below the cutting edge plane 9 before and during the cutting process. Support arrangement 14 rotates, in the cutting region, in the same direction around axis 13, and at the same cadence as printed products 2 that are fed to conveying arrangement 4 or that are transported by conveying arrangement 4. Support arrangement 14, which is configured in a drum-shaped manner, is provided with a plurality of strips 15 distributed at the circumference of the support arrangement to form a circulating cage and extend parallel to the generatrix lines formed by the circulating cage. Each strip 15 has a shoulder 16 at its front edge 15F in the direction of rotation, resting against the rear side of printed product 2 and set back from cutting edge plane 9. The distances of shoulders 16 at the circumference of support arrangement 14 correspond to the distances of conveying units 3 on conveying arrangement 4, but they may also be selected to be shorter or longer.

To improve the cutting rate, shoulder 16 may be configured as an opposing blade, for which purpose the end that is facing edge 10 of blade 11 operates as a cutting edge. It is advantageous if shoulders 16 are exchangeably fastened to strips 15, in a similar manner that blade 11 is fastened to support 12. Strips 15 along with shoulders 16 are configured as sections of a drum and make up a cage-like rotor which rotates around axis 13.

Support 12 can also be configured for a plurality of blades 11 that are to be fastened so that a quick blade replacement is possible by turning support 12 about axis 13 so that a fresh blade can be used in a stationary condition. In the case of a circulatingly driven cutting arrangement 8 (See FIG. 6 and related description below), in which one or a plurality of continuously rotating blades 11 acts in the cutting region of the conveying arrangement 4 or cooperate with shoulders 16 of the support arrangement in the region of their greatest approximation to the conveying arrangement 4, the support 12 is seated on a shaft 17. In short, in one embodiment of the invention (FIG. 4), the blade 11 with its support 12 remains stationary during a cutting process and during another embodiment of the invention (FIG. 6) the blade 11 with its support 12 are rotated during a cutting operation.

Cutting arrangement 8 and support 12 may be configured to carry off cuttings, as is illustrated and known for transverse cutters. For this purpose, shaft 17 is configured to be hollow. The hollow space is connected to a pressure source or vacuum source, and support 12 is provided with a sector-like exhaust space 18 connecting the hollow space of shaft 17 with the cutting region, the exhaust space being limited by strips 15 circulating outside of blades 11.

Figure 5:
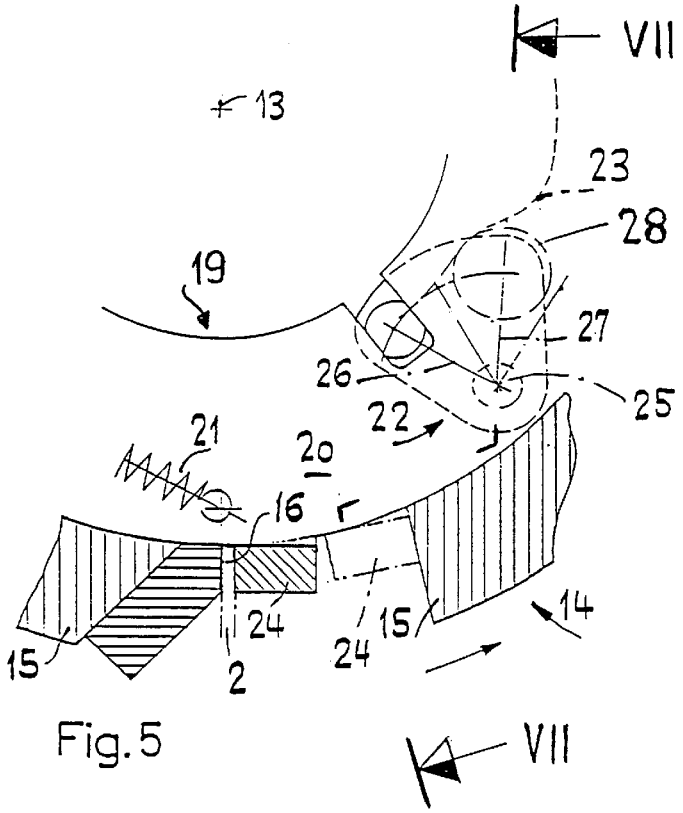
FIG. 5 is a schematic illustration of the mechanism for actuating the counter supporting element shown in the FIG. 4 and 6.

Referring to FIG. 5, there is shown the structure and function of an opposing strip 24 which acts as a counter supporting element. Opposing strip 24 forms a counter supporting element which presses from the opposite side of printed product 2 against shoulder 16 to prevent bending of the printed product and thus to achieve a high cutting stability over the region of the printed product.

On the inner side of support arrangement 14 there is provided a suspension 19 comprising two rotatably seated disks 20 that are disposed coaxially with respect to axis 13. Opposing strip 24 is fastened on either side of support arrangement 14 to the circumference of disks 20. Opposing strip 24 is flexibly pressed against printed product 2 or against shoulder 16, for example, with the force of a spring or pneumatically, i.e., based on the different thicknesses of the printed products that are to be processed. Accordingly, FIG. 5 indicates a tension spring 21, which acts on disks 20 and thus co-circulatingly presses opposing strip 24 against printed product 2, shown in a dash-dotted line.

This pressing force can be counter-balanced by a controlled lever arrangement 22 that acts upon disks 20, the lever arrangement being influenced by a control track 23 which is stationary with respect to the lever arrangement. Lever arrangement 22 is seated on a swivel axis 25 connected to support arrangement 14 and is provided with two lever arms 26, 27, of which the one lever 26 is form-fittingly coupled at the swivel end with disks 20, while the other lever arm 27 is provided at its free end with a control roller 28 moving along a control track 23.

Figure 6:
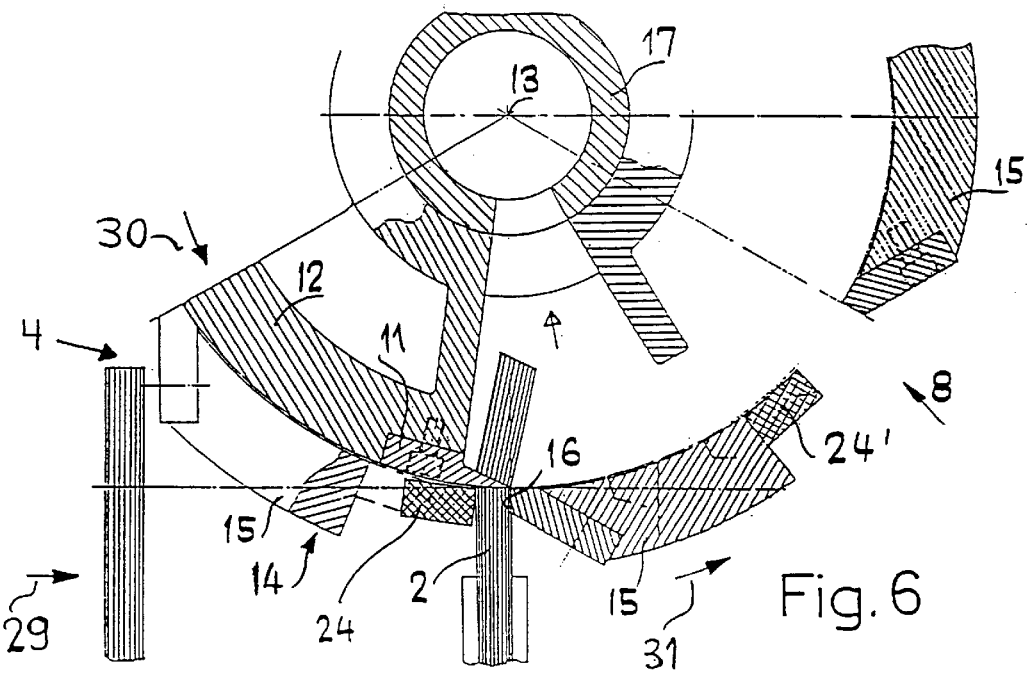
FIG. 6 is a partial view of a section along line IV—IV in FIG. 3 according to an alternative embodiment.

FIG. 6 illustrates an alternative embodiment of a cutting arrangement 8 in cooperation with conveying arrangement 4. Cutting arrangement 8 comprises a support 12 which is provided on its circumference with blades 11, the support 12 being driven at shaft 17 around axis 13 so that, in the cutting region at conveying arrangement 4, support 12 moves in the same direction as the conveying arrangement, but at a higher speed. Rotating strips 15 of support arrangement 14, which is provided with a drum-shaped configuration and surrounds the circulating cutting arrangement 8, are disposed coaxially with respect to axis 13, and have the same direction of rotation as blades 11, but with the speed of the conveying arrangement 4, with the trailing shoulder 16 of the support arrangement respectively supporting a printed product 2 at the overhang. Conveying arrangement 4 is driven in the direction of arrow 29 by the arrangement shown in FIG. 1. Arrows 30 and 31 in FIG. 6 represent driving forces provided by non-illustrated motors for rotating support arrangement 14 and support 12 in the direction and at the relative speeds mentioned above.

In order to keep the printed product 2 compactly pressed together during cutting, an opposing strip 24 of a counter supporting element oriented against shoulder 16 is again provided, with the opposing strip, however, in this embodiment according to FIG. 6 being flexibly pressed against the printed product 2 before cutting by means of accelerating its rotational speed.

In FIG. 6, reference numeral 24' illustrates the position of the opposing strip after cutting in the initial position.

Further to FIG. 4, A indicates a perpendicular distance between the axis 13 to the conveying arrangement 4 which is adjustable.

Figure 7:
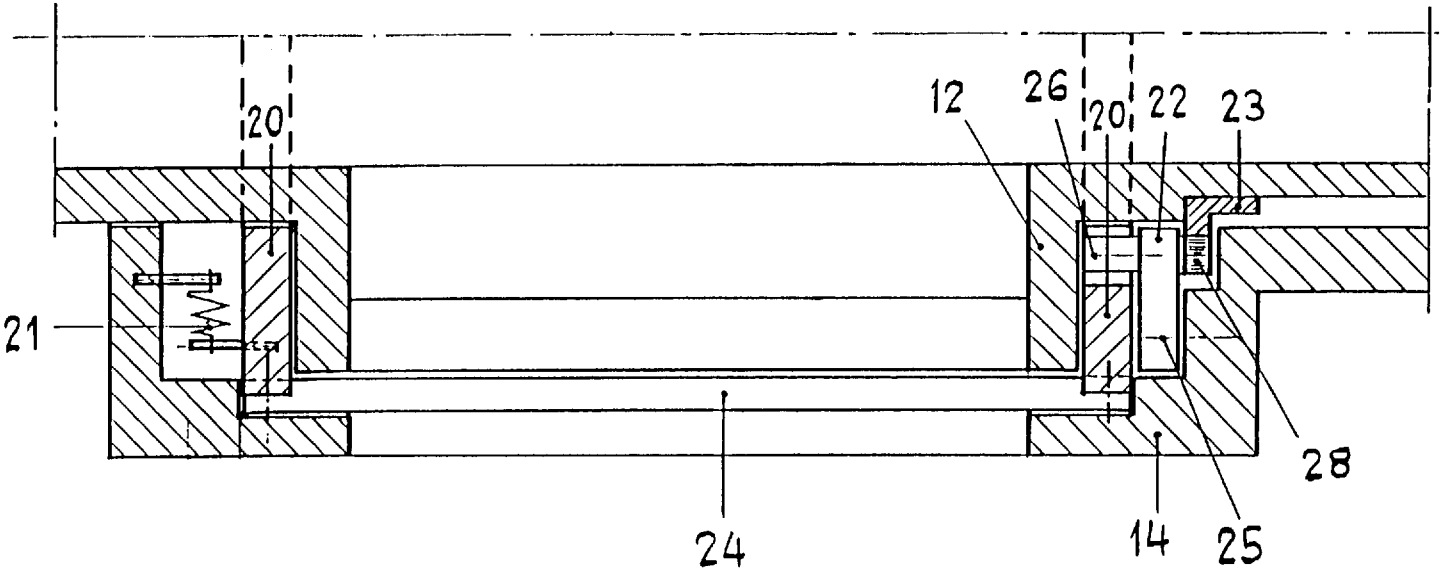
FIG. 7 is a cross section along line VII—VII in FIG. 5

FIG. 7 shows the opposing strip 24 attached to the suspension 19 on each side (i.e., first and second sides) of the support arrangement 14 by two rotatable disks 20.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. In a device for trimming an edge of printed products which are fed continuously at regular distances to a conveying arrangement comprising circulating conveying compartments moving in a direction of conveyance along a path and being loaded from above with the printed products, the printed products having edges projecting at the conveying compartments so that the edges extend through a cutting arrangement comprising a blade and being laterally disposed at the conveying arrangement, the printed products being fed to the cutting arrangement in the direction of conveyance and with a cadence, the improvement comprising:

a driven support arrangement independent of the circulating compartment, including a shoulder which is moved into a position on a rear side of the printed product relative to the blade in a cutting region of the cutting arrangement, the shoulder being set back from the projecting edge of the printed product and disposed opposite the blade during a cutting process, the shoulder being moveable into position at least approximately over a length of a cut by the blade and being driven in the same direction and at the same cadence as the printed products that are fed to the cutting arrangement.

2. A device according to claim 1, wherein the blade has a cutting edge, the device has an axis that is parallel to the cutting edge, and the support arrangement includes a circumference and rotates around the axis, and said shoulder comprises a plurality of shoulders on the circumference of the support arrangement distributed at the same distance as the conveying units.

3. A device according to claim 2, wherein the shoulders of said support arrangement comprise opposing blades cooperating with the blade of said cutting arrangement for cutting the printed products.

4. A device according to claim 2, and further comprising a support to which said blade is fastened, said blade being seated concentrically with respect to said support arrangement and radially within said support arrangement.

5. A device according to claim 4, wherein said support has a circumference and said blade comprises a plurality of blades distributed at the circumference of said support.

6. A device according to claim 2, wherein said support arrangement includes strips configured as sections of a drum which rotates in a direction about the axis, the strips each having a front edge in the direction of rotation of the drum, with each of the shoulders located at a respective one of at the front edges of the strips.

7. A device according to claim 6, further comprising opposing strips located on a side of the printed products opposite a respective one of the shoulders, each said opposing strip located between two of said strips and being driven together with said support arrangement to flexibly press the printed product against a respective one of the shoulders during the cutting process.

8. A device according to claim 7, wherein the support arrangement has first and second sides, the device further including a lever arrangement actuated against a spring force and a suspension connected to the lever arrangement, wherein the opposing strip is fastened to the suspension on the first and second sides of the support arrangement.

9. A device according to claim 8, wherein the lever arrangement includes a first lever arm that is seated to swivel at the support arrangement and a second lever arm that is connected to a control track, and the suspension includes two rotatably seated disks which are coaxially disposed with respect to the support arrangement and are coupled with the lever arrangement for lifting the opposing strip off of the printed product in dependence of a position of the lever arrangement.

10. A device according to claim 2, wherein a perpendicular distance of the axis from the conveying arrangement is adjustable.

11. A device according to claim 1, wherein the blade of the cutting arrangement is oriented to act in a direction opposite of the direction of conveyance of the printed products.

12. A device according to claim 1, further comprising means for driving the support arrangement and the conveying arrangement in the same direction and at the same speed in the cutting region of the cutting arrangement, and for driving the support to which said blade is attached in the same direction at a higher speed in the cutting region with respect to the coaxially circulating support arrangement.

* * * * *